US007148416B1

(12) United States Patent
Rice

(10) Patent No.: US 7,148,416 B1
(45) Date of Patent: Dec. 12, 2006

(54) UNDERSEA VEHICLE

(75) Inventor: James Q. Rice, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1825 days.

(21) Appl. No.: 08/528,624

(22) Filed: Aug. 31, 1995

(51) Int. Cl.
*F42B 19/01* (2006.01)

(52) U.S. Cl. ..... 114/20.1; 114/23

(58) Field of Classification Search ..... 114/312, 114/20.1, 23; 102/503; 367/1; 440/52, 440/66–68, 70, 81
See application file for complete search history.

(56) References Cited

U.S. PATENT DOCUMENTS

| | | | | |
|---|---|---|---|---|
| 1,759,511 A | * | 5/1930 | Kort | 440/38 |
| 1,991,512 A | * | 2/1935 | Miller | 440/38 |
| 3,464,357 A | * | 9/1969 | Duport et al. | 415/193 |
| 5,078,628 A | * | 1/1992 | Garis, Jr. | 440/6 |
| 5,438,947 A | * | 8/1995 | Tam | 114/312 |

FOREIGN PATENT DOCUMENTS

| | | | | |
|---|---|---|---|---|
| DE | 3149618 | * | 7/1983 | 440/68 |
| JP | 279990 | * | 11/1988 | 440/68 |

* cited by examiner

*Primary Examiner*—Timothy D. Collins
(74) *Attorney, Agent, or Firm*—James M. Kasischke; Jean-Paul A. Nasser; Michael P. Stanley

(57) ABSTRACT

An undersea vehicle having both low emitted noise and low reflectivity is provided. The undersea vehicle has a hollow cylindrical hull with all components, sensors, electronics, motors, and other internal components with the exception of the propellers, located within the shell of the cylindrical hull. The hollow center of the hull provides a duct and propeller configuration with the shaping of the inlet tube designed to reduce forward noise transmissions, such as reflected active sonar signals and emitted noise. The internal duct gradually constricts to a throat section and thereafter diverges to an output section where dual counter-rotating propellers are located. The result is that most of the internal turbulent flow and the propeller noise is located behind the throat and is thereby reflected in the aft direction. Steering of the vehicle is accomplished by canting the leading edge intake section and the duct exhaust section.

11 Claims, 3 Drawing Sheets

UNDERSEA VEHICLE

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to quiet undersea vehicles and more particularly to undersea vehicles having internal or ducted propulsor systems.

(2) Description of the Prior Art

It is well known that control surface actuator noise, as well as turbulence induced noise created by the interaction of propellers and control surfaces, are significant sources of unwanted noise on undersea vehicles, such as torpedoes and unmanned undersea vehicles. Present control surfaces and propulsor configurations have unacceptably high acoustic noise levels. A variety of techniques have been used to reduce the amount of noise created by existing electromechanical actuators. In general, these efforts have concentrated on balancing and isolating the moving parts and gears as well as providing fixed hydrodynamic fairings to minimize turbulence-induced noise. Unfortunately, even in the best prior art designs, electromechanical actuator-driven control surfaces suffer from several drawbacks. Actuation of the control surfaces result in gear and motor noise. Further, these control surfaces, typically located ahead of the propellers, create a turbulent wake behind the control surfaces. The ingestion of this wake by the propellers generates significant flow noise levels. The flow noise is created by three mechanisms: (1) the turbulence directly radiating to the near and far field, (2) the induced noise due to the turbulent excitation of the control surface and the surrounding structure, and (3) interaction of the control surface wake with the propulsor. The third item causes fin and structure re-radiation which is the dominant flow noise source.

Additionally, in remotely-operated undersea vehicles, used in surveillance or reconnaissance, a low reflectivity profile is needed to avoid active sonar detection. The conventional structure of fins, control surfaces and propellers creates multiple corner reflectors resulting in very strong return echoes. An undersea vehicle used in covert surveillance must have a minimum of external structure for controls and propulsion.

SUMMARY OF THE INVENTION

Accordingly, it is an object of the present invention to provide an undersea vehicle having low-emitted noise caused by propulsor-control surface interaction.

It is a further object of the invention to provide an undersea vehicle having reduced turbulence in the propulsor region.

It is another object of the invention to provide an undersea vehicle having reduced turbulence in the control surface region.

It is yet another object of the invention to provide an undersea vehicle with a reduced reflective surface for avoiding active acoustic detection systems.

It is still another object of the invention to provide a reduced acoustic signature of the propulsor in the forward hemisphere.

The foregoing and other objects are realized by providing a hollow undersea vehicle having an internal ducted propulsor system and having internal and external shaping to avoid forward emission of acoustic energy. The external hull is a nearly planar cylinder providing a smooth, low turbulence surface. This surface reduces reflectivity toward the forward hemisphere of any active sonar energy received from the forward hemisphere. Additionally, the internal inlet tube is shaped to trap acoustic energy entering the inlet. The aft portion of the hollow body is shaped to avoid both reflected and emitted noise in the forward direction. The canting of the leading surfaces of the inlet and the trailing surface of the exhaust nozzle provide for maneuver and control, thereby avoiding reflective surfaces and reducing control surface turbulence. The result is a low noise and non-reflective body as viewed from a frontal hemisphere.

BRIEF DESCRIPTION OF THE DRAWINGS

The foregoing objects and further advantages of the invention will be more fully understood from the following detailed description with reference to the following figures wherein.

DESCRIPTION OF THE PREFERRED EMBODIMENTS

Figure 1:
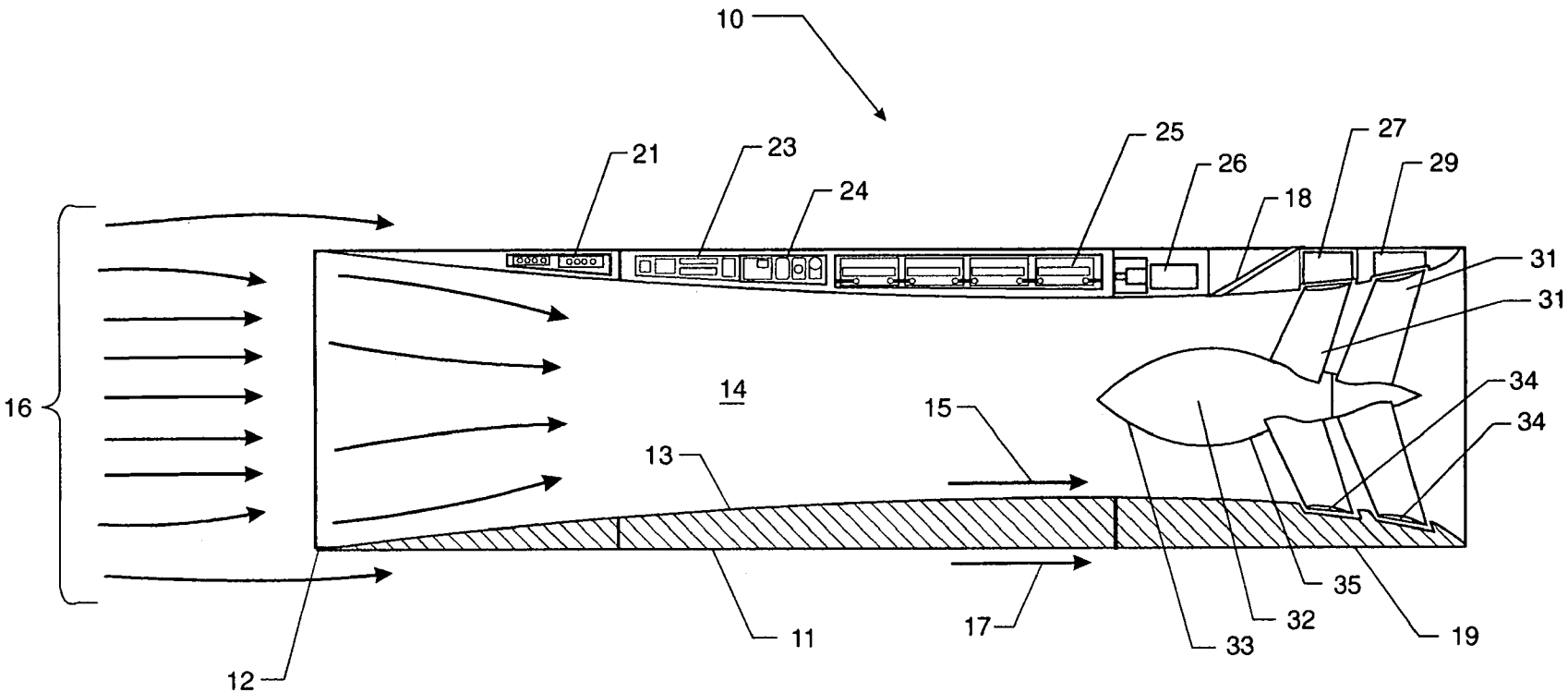
FIG. 1 is a sectional side view of the undersea vehicle.

Referring now to FIG. 1, the undersea vehicle, designated generally by the reference numeral 10, is shown with its major components. The vehicle has a hollow cylindrical hull 11 which encloses an internal duct 14. Hollow cylindrical hull 11 has three sections, an intake section 12, a throat section 13 and an output section 19. Intake section 12 has a sharpened leading edge. The payload and the operating elements of the vehicle are located between the hull 11 and the wall of the internal duct 14. The payload in this embodiment is an array of sensors 21, as used for a surveillance vehicle. Alternatively, a warhead and fusing mechanism can replace the sensor array 21. A central processor unit 23 receives information from the sensor array 21 and generates data to the guidance and control unit 24. A plurality of batteries located in the battery pack 25 provides power to operate the onboard electronics (sensors, navigation, control, and computer processor) and to operate a propulsion system located in output section 19. The propulsion system comprises a motor inverter assembly 26 having an inverter and controller and the circumferential drive motors 27 and 29. The counter-rotating propellers 31 are mounted to the inside of rotating circumferential shrouds 34 which are the driven rotors of the circumferential drive motors. The propellers 31 are fully supported by the circumferential shrouds 34 and require no center supports. As a result, the center structure at the propeller hub 32 can be designed for best flow and acoustic performance without interference by structural supports.

The shaping of the internal and external shape of the hollow hull provides a reduction in flow noise by reducing surface turbulence. The external surface of hull 11 is a nearly flat cylinder. This shape reduces the pressure gradient along the external surface of hull 11 as compared to the more conventional curving hull form. As a result, the transition of the freestream flow 16 to turbulent flow is delayed to a point further aft on the hull 11, depicted in this figure, by turbulent flow arrow 17. An additional advantage of the flat cylindrical outer surface is that active acoustic energy, such as produced by sonar search arrays, has a single reflective plane without reflective corners. A sonar array, impinging energy on the undersea vehicle from the forward hemisphere, will produce a sonar return first reflected into the rearward hemisphere, and secondarily diffused by the radial surface of the hull. The only location where an array might produce a good return is from the direct beam position, that is, scanning at an angle directly from the side of the vehicle. Any other position results in a return echo directed away from the transmitting sonar array. Even from the beam position, the return echo will be weakened by the lack of corner surfaces and the curvature of the cylindrical hull. Since there are no external propellers or fins, this reduced return echo allows the undersea vehicle to approach very close to a sonar array without detection.

With respect to acoustic energy transmitted into the intake section 12, the sharpened leading edge provides only a minimal surface for acoustic reflection. Likewise, the gradual converging throat section 13 of the intake reduces turbulence transition in the interior of the vehicle while providing a swallowing effect on any acoustic energy received in the forward hemisphere. The throat section 13 biases the echo reflectivity by dissipating the energy in repeated reflection toward the output section 19. Energy that is reflected by propeller 31 must reflect repeatedly within the duct. As a result, virtually no return is received on acoustic energy transmitted from the forward hemisphere.

With respect to acoustic energy produced by the vehicle itself, that is, the propeller turbulence noise generated internally in the duct 14, several features minimize the forward transmission of such noise. First, flow within the duct 14 is low in turbulence. Second, the turbulent boundary layer along the inner wall of the duct is drawn off just prior to impingement of the propellers 31 by boundary layer bleed ducts 18. By these features, the flow reaching the propellers 31 has greatly reduced turbulence (and noise) as compared to a typical external propeller located behind fins and control surfaces.

Additionally, the propeller hub 32 is shaped within a converging intake section 33 and diverging exhaust section 35. This shaping produces a second throat in the flow field thereby providing an additional bias for reflecting acoustic energy to the rearward hemisphere.

Figure 2:
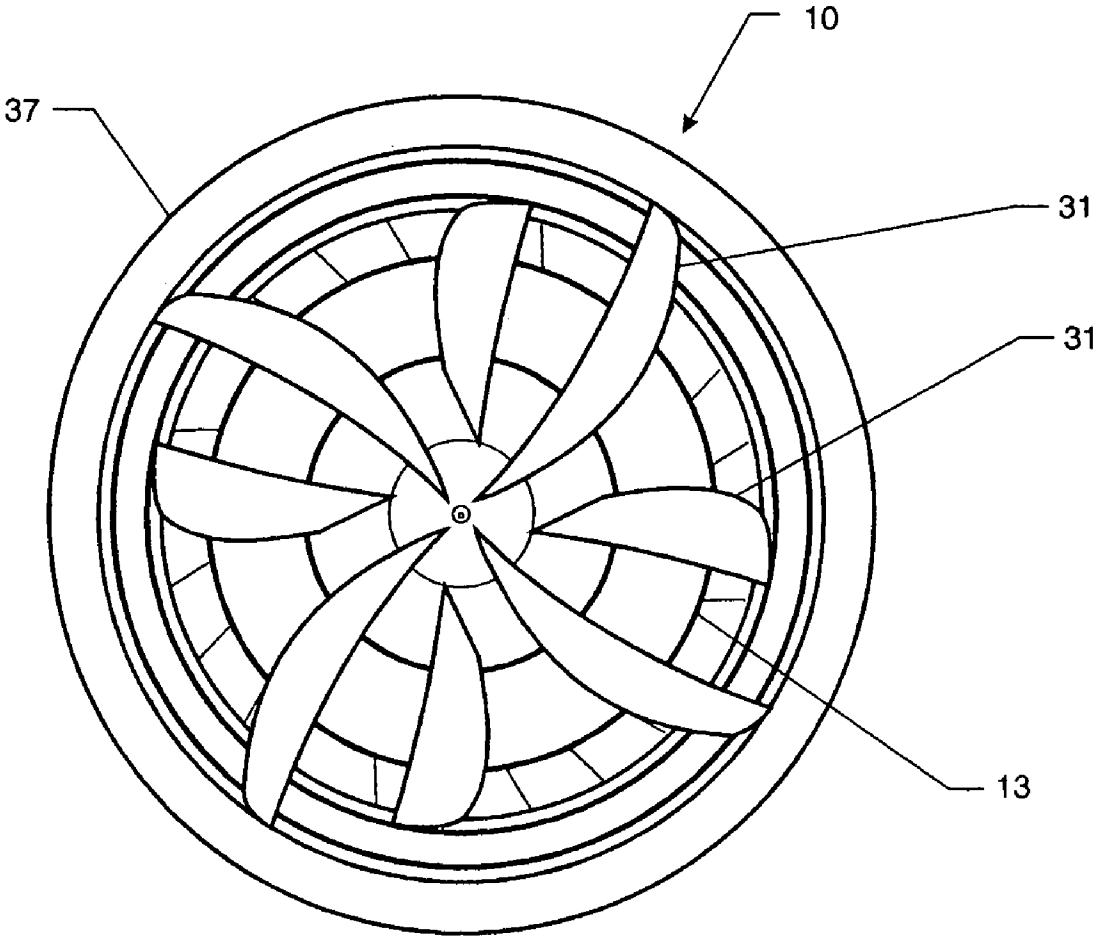
FIG. 2 is an aft view of the undersea vehicle showing the propulsor section.

The bias effect can be seen clearly in the aft view of FIG. 2. Vehicle 10 has an aft control surface 37 more fully described in FIG. 3. The converging throat section 13 of the internal duct 14 can be seen in relation to the propeller 31 tips. Although propeller tip noise is reduced by the end plate effect of the propeller shrouds 34, even that reduced noise is blocked from direct forward transmission by the reducing duct cross-section. The effect is similar to speaking into the wrong end of a megaphone.

Figure 3:
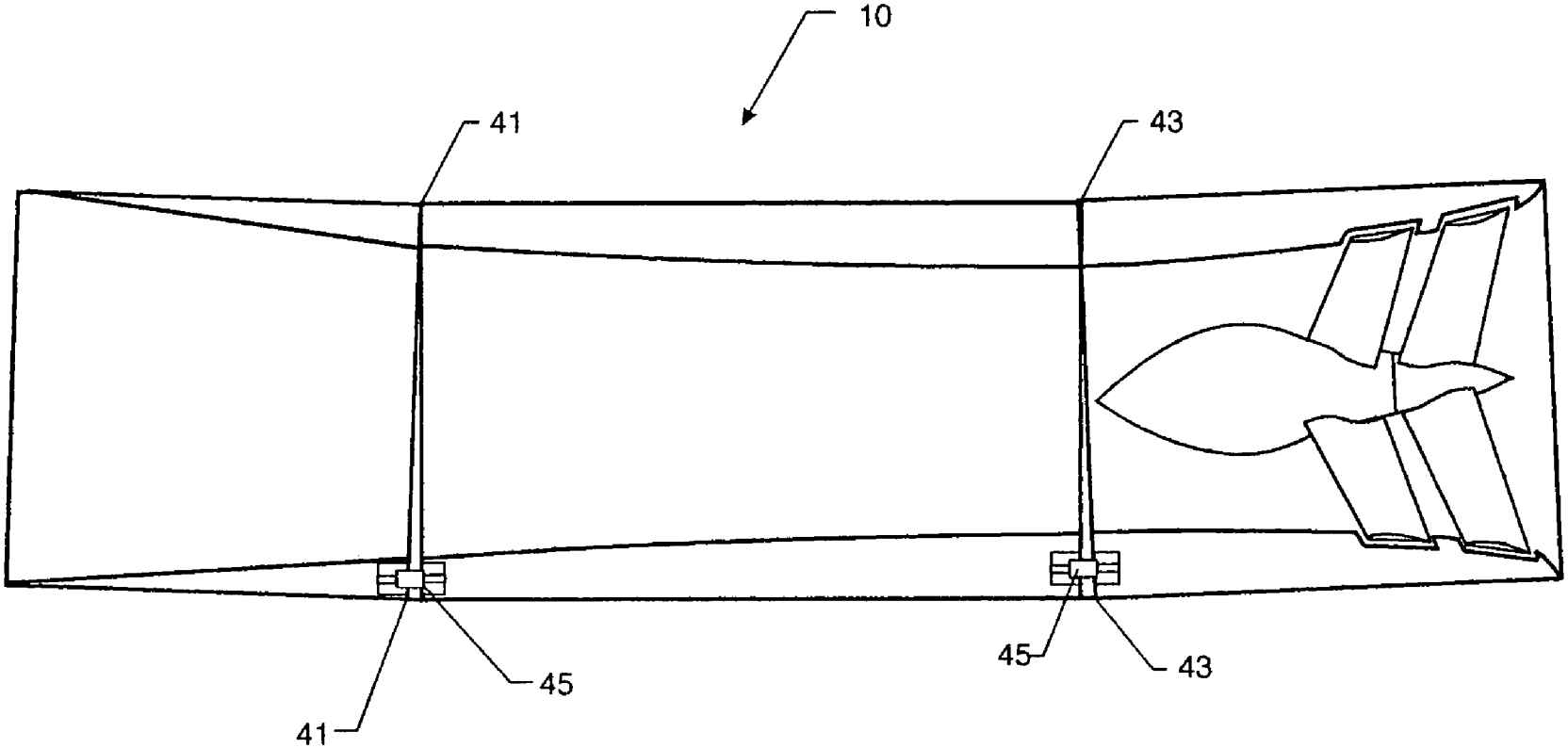
FIG. 3 is a cross-section showing the inlet leading edge and exhaust nozzle control mechanisms.

Referring now to FIG. 3, maneuver control of the vehicle may be understood. The control mechanism of the undersea vehicle (not called out in prior figures for purpose of clarity) comprises two circumferential elastomeric joints, a forward joint 41 and a rearward joint 43. Forward joint 41 is positioned between intake section 12 and throat section 13; likewise, rearward joint 43 is positioned between throat section 13 and output section 19. These joints allow extension and bending required to cant both the intake section 12 and output section 19 of the hull 11, thereby producing up to 10° of canting for each section. The canting is accomplished by eight steering actuators 45 at each joint 41 and 43. Steering actuators 45 are preferably solenoids having multiple positions which are joined to the vehicle's guidance system. These actuators are evenly spaced around the circumference of vehicle 10. As the guidance system of the vehicle maintains an inertial reference, it is not necessary to maintain any particular orientation of the vehicle during operation. Turning and diving or ascending can be accurately accomplished while the vehicle is in any fixed roll orientation and during active rolling motion.

The features and advantages of the invention are numerous. The vehicle produces very little reflected acoustic energy in the forward hemisphere. Further, the emitted noise of the vehicle is very low due to reduced turbulence, reduced propeller noise and minimal actuator noise. Additionally, that noise which is generated by the vehicle is largely transmitted rearward.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An undersea vehicle comprising:

a hollow hull defining an internal duct therethrough and having a means for reducing external turbulence, said hollow hull having a cantable exhaust section and a throat section attached to each other;

a means for steering said hollow hull, said means for steering controlling internal flow within said hollow hull and external flow about said hollow hull, said means for steering comprising a circumferential elastomeric joint attached to said cantable exhaust section and to said throat section, and a plurality of actuators attached between said exhaust section and said throat section to cant said cantable exhaust section with respect to said throat section;

a means for reducing reflectivity of acoustic energy in a forward direction;

a means for propelling said hollow hull located within the hollow hull; and a means for reducing acoustic transmissions in a forward direction, said acoustic transmission being caused by operation of said means for propelling.

2. An undersea vehicle as in claim 1 wherein said hollow hull means for reducing external turbulence comprises a substantially smooth cylindrical outer surface of said hollow hull.

3. An undersea vehicle as in claim 1 wherein said hollow hull has a substantially smooth cylindrical outer surface, an internal duct, and a sharpened leading edge.

4. An undersea vehicle as in claim 3 wherein said hollow hull defines an internal converging section and an internal diverging section in said internal duct.

5. An undersea vehicle as in claim 4 wherein said means for reducing acoustic transmissions comprises a propeller hub located within the internal diverging section in said internal duct, said propeller hub defining a second converging section and a second diverging section.

6. An undersea vehicle as in claim 1 wherein said means for propelling comprises a plurality of propellers located within said hollow hull, said plurality of propellers having circumferential shrouds attached to tips of said propellers.

7. An undersea vehicle as in claim 6 wherein said means for propelling further comprises:

a plurality of batteries;

an inverter, having an attached controller, said inverter being connected to said plurality of batteries; and a plurality of circumferential electric motors electrically connected to said inverter and connected to rotate said plurality of propellers.

8. An undersea vehicle as in claim 1 wherein said means for reducing acoustic transmissions comprises said hollow hull means having boundary layer bleed ducts therethrough positioned inside said hollow hull and in communication with the exterior of said hollow hull for drawing off turbulent boundary layer flow just prior to said means for propelling.

9. An undersea vehicle comprising:

a hollow cylindrical hull having an internal duct therethrough, an intake section, a throat section, and an exhaust section;

a plurality of circumferential drive motors located within said exhaust section of said hollow cylindrical hull;

a plurality of shrouded propellers located within said exhaust section of said hollow cylindrical hull internal duct, said propeller shrouds being driven by said circumferential drive motors;

a propeller hub connecting the centers of said shrouded propellers, said hub shaped to form a converging intake section and diverging exhaust section;

an inverter, having an attached controller, located within said hollow cylindrical hull and being electrically connected to said plurality of circumferential drive motors;

a plurality of batteries located within said hollow cylindrical hull and electrically connected to said inverter;

guidance and control electronics located within said hollow cylindrical hull, said electronics being electrically connected to said plurality of batteries and further connected to said inverter;

a central processor unit located within said hollow cylindrical hull, said processor unit connected to said guidance and control electronics;

means for steering joined to said cylindrical hull and connected to said guidance and control electronics; and a plurality of sensors located within said hollow cylindrical hull intake section.

10. An undersea vehicle as in claim 9 wherein said means for steering comprises:

said intake section of said cylindrical hull being cantable with respect to said throat section;

said exhaust section of said cylindrical hull being cantable with respect to said throat section;

a first elastomeric joint positioned between said intake section and said throat section;

a plurality of forward actuators joined between said intake section and said throat section and connected to said guidance and control electronics to cant said intake section;

a second elastomeric joint positioned between said throat section and said exhaust section; and a plurality of aft actuators joined between said throat section and said exhaust section and connected to said guidance and control electronics to cant said exhaust section.

11. An undersea vehicle as in claim 10 wherein said forward and aft actuators comprise multi-position solenoids.

* * * * *